US011162397B2

(12) United States Patent
Blackmur

(10) Patent No.: US 11,162,397 B2
(45) Date of Patent: Nov. 2, 2021

(54) ELECTRICALLY ACTUATED CAMSHAFT PHASER FLUID ESCAPEMENT CHANNEL

(71) Applicant: BorgWarner, Inc., Auburn Hills, MI (US)

(72) Inventor: Shawn Blackmur, Brooktondale, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 17/047,827

(22) PCT Filed: May 3, 2018

(86) PCT No.: PCT/US2018/030857
§ 371 (c)(1),
(2) Date: Oct. 15, 2020

(87) PCT Pub. No.: WO2019/212555
PCT Pub. Date: Nov. 7, 2019

(65) Prior Publication Data
US 2021/0115819 A1 Apr. 22, 2021

(51) Int. Cl.
*F01L 1/352* (2006.01)
*F01L 1/344* (2006.01)
(Continued)

(52) U.S. Cl.
CPC ..... *F01L 1/352* (2013.01); *F01L 1/34409* (2013.01); *F01M 9/10* (2013.01); *F01M 9/105* (2013.01);
(Continued)

(58) Field of Classification Search
CPC ..... F01L 1/352; F01L 1/46; F01L 2013/103; F01L 2810/02; F01L 2820/032; F01M 9/10; F01M 9/105; F01M 9/108
(Continued)

(56) References Cited

U.S. PATENT DOCUMENTS

2007/0202981 A1* 8/2007 Sugiura ..... F16H 1/32 475/162
2008/0083384 A1* 4/2008 Morii ..... F01L 1/356 123/90.15
(Continued)

FOREIGN PATENT DOCUMENTS

WO 2016036528 A1 3/2016

OTHER PUBLICATIONS

International Search Report for international patent application No. PCT/US2018/030857 filed on May 3, 2018, dated Jan. 31, 2019.

*Primary Examiner* — Jorge L Leon, Jr.
(74) *Attorney, Agent, or Firm* — Reising Ethington P.C.

(57) ABSTRACT

An electrically-actuated camshaft phaser used in an internal combustion engine including a camshaft sprocket, configured to receive rotational input from a crankshaft, that includes a sprocket ring gear having a plurality of radially-inwardly facing gear teeth and a radially extending sprocket side; a camshaft plate that includes a camshaft ring gear having a plurality of radially-inwardly facing gear teeth and a radially extending camshaft side; a plurality of planetary gears having radially-outwardly facing gear teeth, each gear with a first radial gear face and a second radial gear face, wherein the planetary gears engage the sprocket ring gear, the camshaft ring gear, or both the sprocket ring gear and the camshaft ring gear; and one or more fluid escapement channels formed in at least one of the camshaft sprocket, the camshaft plate, the first radial gear face, or the second radial gear face.

15 Claims, 4 Drawing Sheets

(51) Int. Cl.

| | |
|---|---|
| ***F01M 9/10*** | (2006.01) |
| *F01L 1/047* | (2006.01) |
| *F01L 13/00* | (2006.01) |

(52) U.S. Cl.
CPC ..... *F01M 9/108* (2013.01); *F01L 1/047* (2013.01); *F01L 2013/103* (2013.01); *F01L 2250/02* (2013.01); *F01L 2810/02* (2013.01); *F01L 2820/032* (2013.01)

(58) Field of Classification Search
USPC ..... 123/90.15, 90.17, 90.33
See application file for complete search history.

(56) References Cited

U.S. PATENT DOCUMENTS

| | | | | |
|---|---|---|---|---|
| 2008/0083388 | A1* | 4/2008 | Uehama ..... | F01L 1/352 123/90.17 |
| 2012/0186548 | A1 | 7/2012 | David et al. | |
| 2013/0008398 | A1 | 1/2013 | Stoltz-Douchet et al. | |
| 2015/0345345 | A1 | 12/2015 | Showalter | |
| 2018/0038246 | A1* | 2/2018 | Toda ..... | F01L 1/352 |
| 2019/0353237 | A1* | 11/2019 | Weber ..... | F01L 1/047 |

* cited by examiner

ELECTRICALLY ACTUATED CAMSHAFT PHASER FLUID ESCAPEMENT CHANNEL

CROSS-REFERENCE TO RELATED PATENT APPLICATION

This is a U.S. non-provisional national phase patent application claiming the benefit of priority from Patent Cooperation Treaty international patent application number PCT/US18/30857 filed on May 3, 2018, the entire contents of which are herein incorporated.

TECHNICAL FIELD

The present application relates to internal combustion engines (ICEs) and, more particularly, to variable camshaft timing (VCT) used with ICEs.

BACKGROUND

Variable camshaft timing (VCT) can be used with internal combustion engines (ICEs) to selectively change the angular position of camshaft(s) relative to the angular position of the crankshaft. VCT can be implemented in a variety of different ways. For example, camshaft phasers can be used to change the angular position of a camshaft relative to the angular position of a crankshaft. This can be called changing the phase of the camshaft(s) relative to the crankshaft. The mechanisms for actuating camshaft phasers can vary as well; some camshaft phasers are actuated hydraulically using engine oil from the ICE while others are actuated electrically using an electric motor to control the angular position of the camshaft relative to the angular position of the crankshaft.

Electrically-actuated camshaft phasers, sometimes referred to as ePhasers, can use an electric motor controlling a gearbox to vary the angular position of the camshaft(s) relative to the angular position of the crankshaft. The gears included in the gearbox can be lubricated with a fluid that may be supplied by the ICE or sealed within the electrically-actuated camshaft phaser. The gears included within the gearbox each have a plurality of gear teeth. The gear teeth from one gear engage and mesh with the gear teeth of another gear as the gears rotate during phaser operation. As the gear teeth mesh, the fluid lubricating the gears can be moved out of the gear path where the gears contact each other. However, moving the fluid away from the gear path can introduce unwanted drag on the gearbox—especially during low temperatures—when the viscosity of fluid lubrication may be relatively high. The increased drag can result in a camshaft phaser having an electric motor that consumes more power to compensate for the drag as well as consuming an increased amount of time to adjust the phase of the camshaft.

SUMMARY

In one implementation, an electrically-actuated camshaft phaser used in an internal combustion engine has a camshaft sprocket, configured to receive rotational input from a crankshaft, that includes a sprocket ring gear having a plurality of radially-inwardly facing gear teeth and a radially extending sprocket side; a camshaft plate that includes a camshaft ring gear having a plurality of radially-inwardly facing gear teeth and a radially extending camshaft side; a plurality of planetary gears having radially-outwardly facing gear teeth, each gear with a first radial gear face and a second radial gear face, wherein the planetary gears engage the sprocket ring gear, the camshaft ring gear, or both the sprocket ring gear and the camshaft ring gear; and one or more fluid escapement channels formed in at least one of the camshaft sprocket, the camshaft plate, the first radial gear face, or the second radial gear face.

In another implementation, an electrically-actuated camshaft phaser used in an internal combustion engine, has a camshaft sprocket, configured to receive rotational input from a crankshaft, that includes a sprocket ring gear having a plurality of radially-inwardly facing gear teeth and a radially extending sprocket side; a camshaft plate that includes a camshaft ring gear having a plurality of radially-inwardly facing gear teeth and a radially extending camshaft side; a compound planetary gear including a camshaft planetary gear and a sprocket planetary gear each having radially-outwardly facing gear teeth, wherein the compound planetary gear includes a first radial gear face and a second radial gear face, and wherein the camshaft planetary gear engages the camshaft ring gear, and the sprocket planetary gear engages the sprocket ring gear; and one or more fluid escapement channels formed in at least one of the camshaft sprocket, the camshaft plate, the first radial gear face of the compound planetary gear, or the second radial gear face of the compound planetary gear.

In another implementation, an electrically-actuated camshaft phaser used in an internal combustion engine (ICE) includes a camshaft sprocket, configured to receive rotational input from a crankshaft, that includes a sprocket ring gear having a plurality of radially-inwardly facing gear teeth and a radially extending sprocket side; a camshaft plate that includes a camshaft ring gear having a plurality of radially-inwardly facing gear teeth and a radially extending camshaft side; a planetary gear having radially-outwardly facing gear teeth engaging the camshaft ring gear and the sprocket planetary gear; and one or more fluid escapement channels formed in at least one of the camshaft sprocket, the camshaft plate, or a radial gear face of the planetary gear.

DETAILED DESCRIPTION

An electrically-actuated camshaft phaser includes a geared transmission or gearbox using one or more fluid escapement channels that are recessed from radially-extending camshaft phaser surfaces or gear surfaces and are adjacent to the gear teeth to efficiently remove lubrication fluid from the gear path of engaged gears. Fluid escapement channels can be formed in one or more components of the camshaft phaser, such as the planetary gears or the housing. As fluid is displaced from the gear path when the gear teeth mesh and contact each other, the fluid can move away from the gear path and into the fluid escapement channel. The fluid escapement channels can be formed as recessed channels or grooves in surfaces of phaser components. The fluid escapement channels can be formed on one or both radial gear face sides of each gear, a radially-extending surface of the camshaft sprocket, or a radially-extending surface of the camshaft sprocket.

Figure 1:
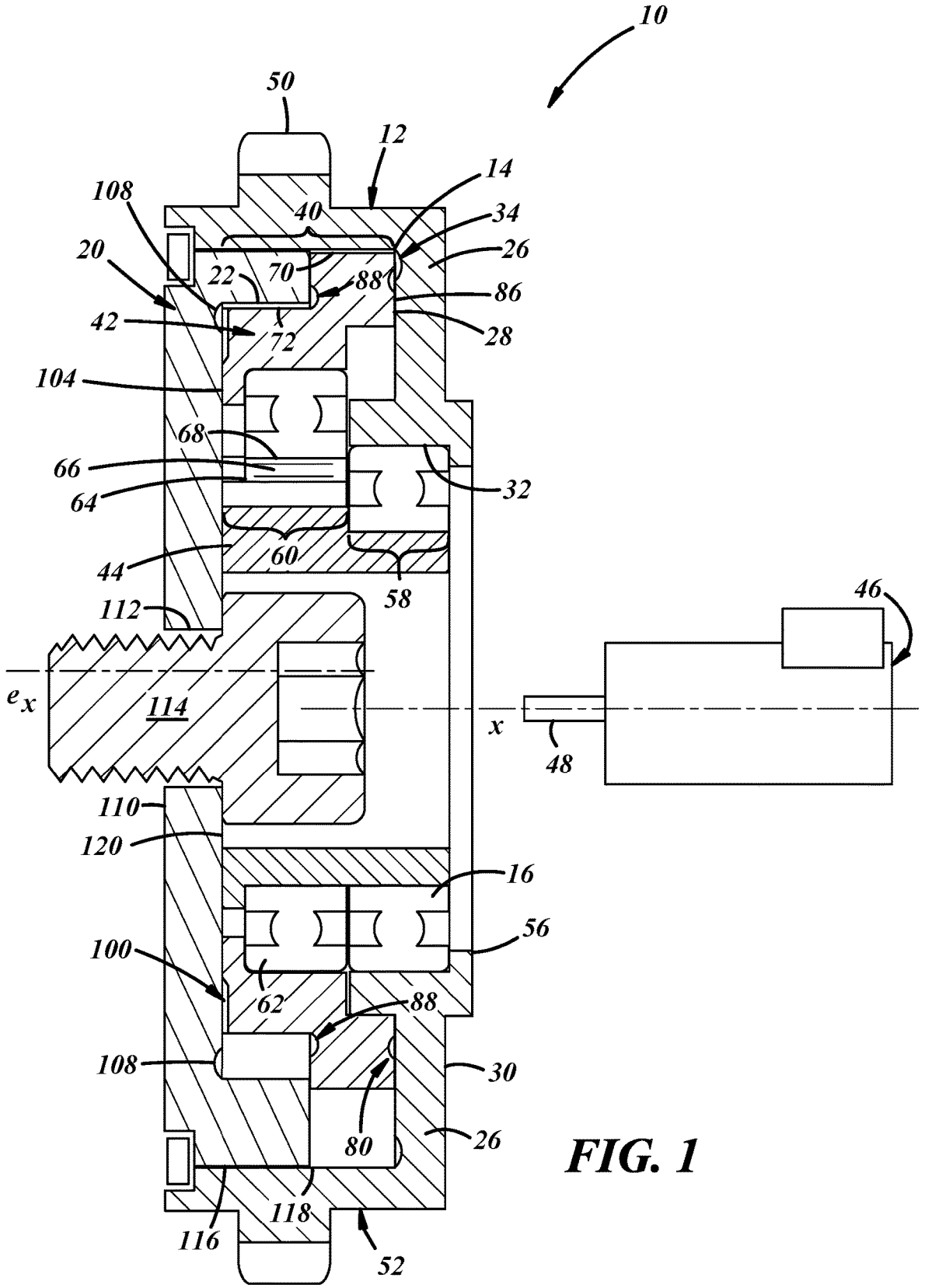
FIG. 1 is a cross-sectional view depicting an implementation of an electrically-actuated camshaft phaser having fluid escapement channels.
Figure 2:
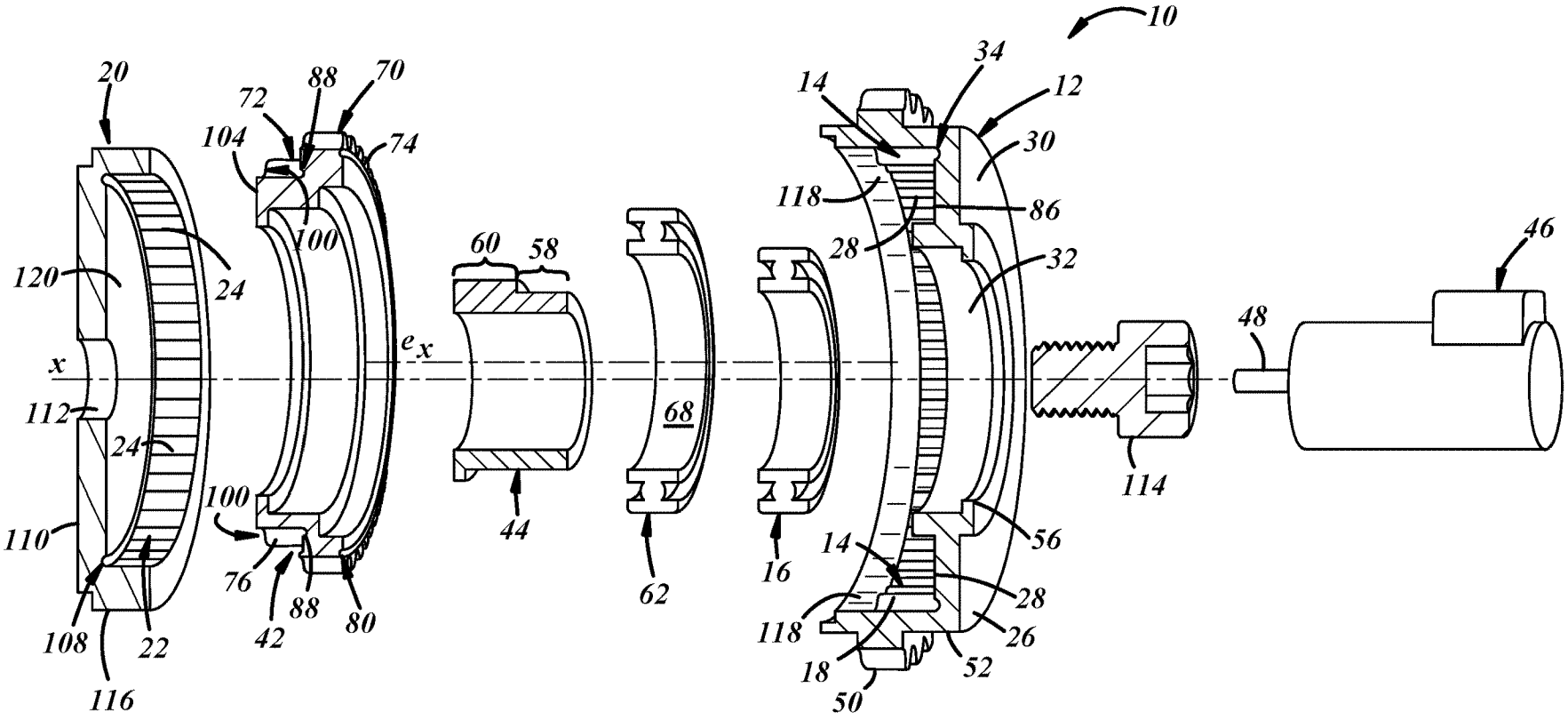
FIG. 2 is an exploded view depicting an implementation of an electrically-actuated camshaft phaser having fluid escapement channels.
Figure 3:
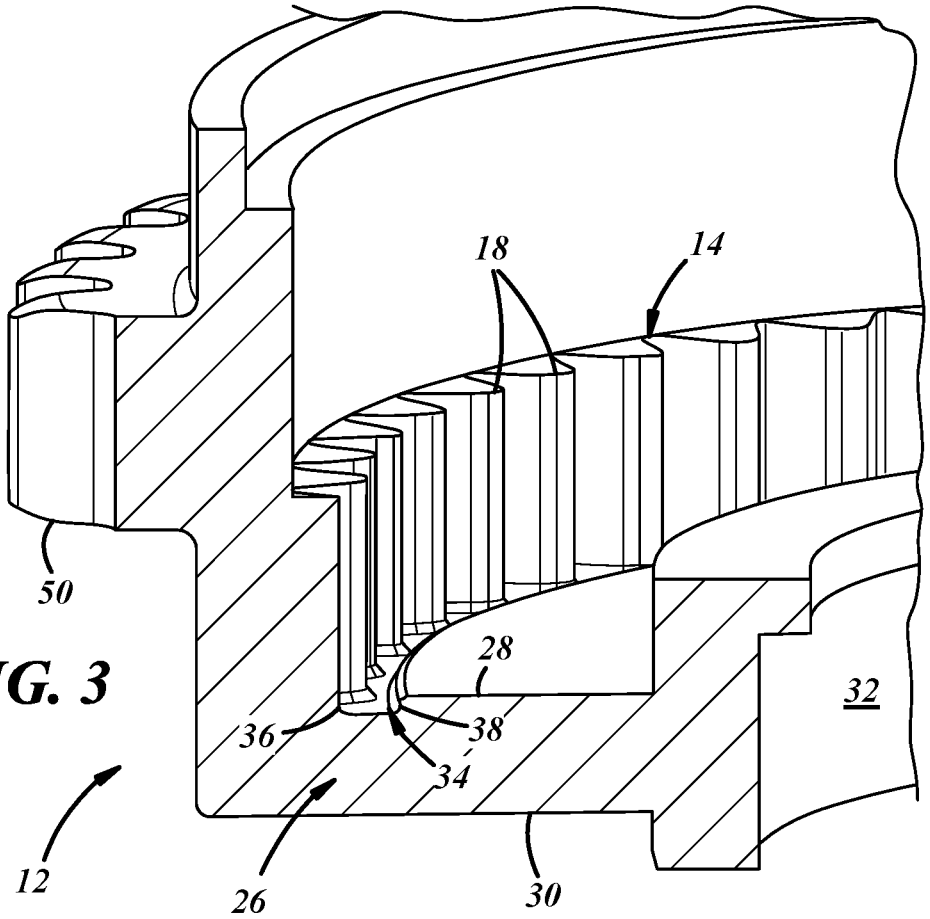
FIG. 3 is a perspective view depicting a portion of an implementation of an electrically-actuated camshaft phaser having fluid escapement channels.
Figure 4:
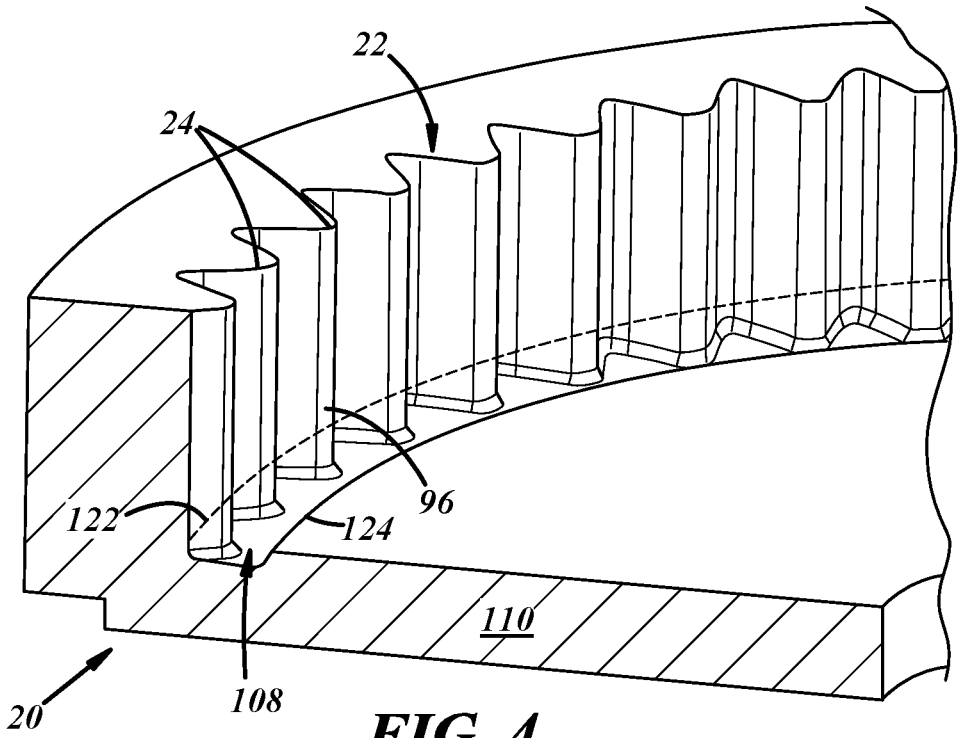
FIG. 4 is a perspective view depicting another portion of an implementation of an electrically-actuated camshaft phaser having fluid escapement channels.
Figure 5:
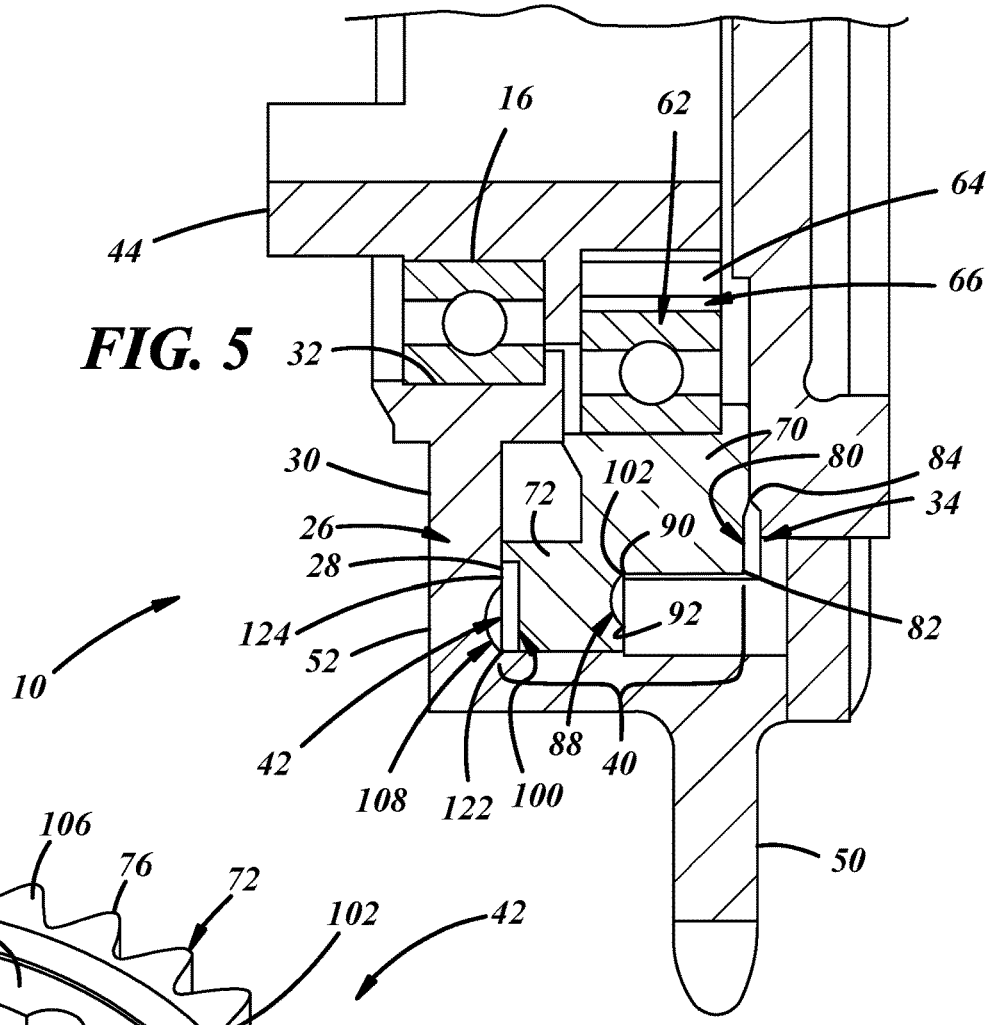
FIG. 5 is a cross-sectional view depicting a portion of an implementation of an electrically-actuated camshaft phaser having fluid escapement channels.
Figure 6:
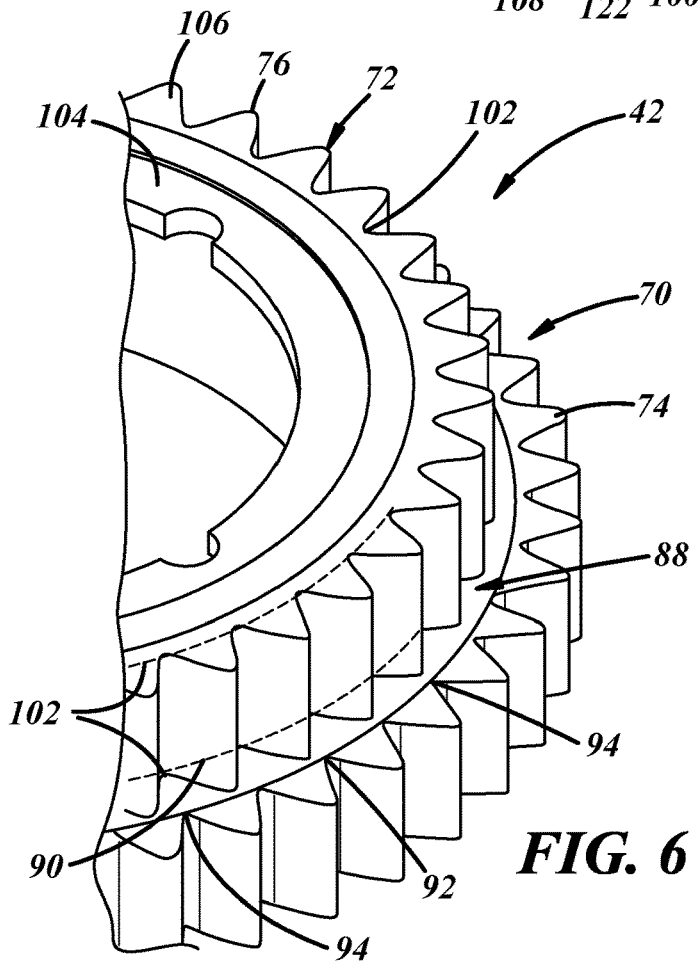
FIG. 6 is a perspective view depicting a portion of an implementation of an electrically-actuated camshaft phaser having fluid escapement channels.

An embodiment of an electrically-actuated camshaft phaser that is controlled using an electric motor and an eccentric shaft is shown in FIGS. 1-6. The camshaft phaser 10 includes a camshaft sprocket 12 that connects to a crankshaft and includes a sprocket ring gear 14 and a sprocket bearing 16. The sprocket ring gear 14 includes a set of inwardly-facing gear teeth 18. A camshaft plate 20 attaches to a camshaft and includes a camshaft ring gear 22 comprising a separate set of inwardly-facing gear teeth 24. The camshaft sprocket includes a radially-extending side 26 that includes an axially inwardly facing surface 28 and an axially outwardly-facing surface 30. The inwardly-facing surface 28 is directed toward the planetary gears of the phaser 10 while the outwardly-facing surface 30 can face in the opposite direction. The radially-extending sprocket side 26 may include a bearing opening 32 that can receive a phaser bearing or bushing. A camshaft sprocket fluid escapement channel 34 can be formed in the axially inwardly-facing surface 28 of the radially-extending sprocket side 26. The camshaft sprocket fluid escapement channel 34 can have first edge 36 that abuts or is coterminous with the sprocket ring gear 14 and a second edge 38 that is radially spaced apart from the first edge 36. The distance between the first edge 36 and the second edge 38 can be equal to or less than the height of the gear teeth 18 of the sprocket ring gear 14 and the depth can be varied based on a number of factors, such as the size of the gear teeth 18 of the sprocket ring gear 14. The fluid escapement channels can help remove lubrication fluid from a gear path 40 while permitting the gears to be moved closer axially to other gears or camshaft phaser surfaces thereby reducing the overall axial length of the camshaft phaser.

A compound planetary gear 42 uses two sets of outwardly facing gear teeth that engage with the camshaft ring gear 22 and the sprocket ring gear 14. An eccentric shaft 44 connects to the camshaft sprocket 12 or the camshaft plate 20 such that a portion of the eccentric shaft 44 rotates about the axis (x). The eccentric shaft 44 also connects to the compound planetary gear 42 along an eccentric axis (ex). The camshaft sprocket 12 and the camshaft plate 20 each rotate about axis (x). A portion of the eccentric shaft 44 is rotationally driven by an electric motor 46 about axis x according to desired phasing such that the compound planetary gear 42 rotates about the eccentric axis ex.

Operating the electric motor 46 so that an output shaft 48 rotates the eccentric shaft 44 at the same speed as the camshaft sprocket 12 maintains an existing angular position of the camshaft relative to the crankshaft. Changing the rate at which the output shaft 48 rotates relative to the rate at which the camshaft sprocket 12 rotates changes the angular position (also called "phase") of the camshaft relative to the crankshaft. For example, when the output shaft 48 rotates faster than the camshaft sprocket 12, the eccentric shaft 44 rotates the compound planetary gear 42 relative to the sprocket ring gear 14 and the camshaft ring gear 22 thereby displacing the camshaft plate 20 relative to the camshaft sprocket 12 to advance the phase of the camshaft relative to the crankshaft. And when the output shaft 48 rotates slower than the camshaft, the eccentric shaft 44 rotates the compound planetary gear 42 relative to the sprocket ring gear 14 and the camshaft ring gear 22 thereby displacing the camshaft plate 20 relative to the camshaft sprocket 12 to retard the phase of the camshaft relative to the crankshaft.

The camshaft sprocket 12 receives rotational drive input from the engine's crankshaft and rotates about the axis (x). An endless loop power transmission member, such as a timing chain or a timing belt, can be looped around the sprocket 12 and around the crankshaft so that rotation of the crankshaft translates into rotation of the sprocket 12 via the member. Other techniques for transferring rotation between the sprocket 12 and crankshaft are possible. Along an outer surface, the sprocket 12 has a plurality of sprocket teeth 50 for mating with the timing chain, with the timing belt, or with another component. As shown, the sprocket 12 has a housing 52 spanning axially from the sprocket teeth 50. The housing 52 includes the sprocket ring gear 14 within the housing 52 and radially inward from the sprocket teeth 50. The sprocket ring gear 14 includes a plurality of inwardly-facing gear teeth 18. The radially-extending side 26 includes the bearing opening 32 that is roughly the same diameter as the sprocket bearing 16. The sprocket bearing 16 is received by the sprocket 12 in the bearing opening 32 and abuts a bearing shoulder 56. In one implementation, all of the components of the camshaft phaser 10 are located in the axial space of the housing 52.

The eccentric shaft 44 includes a camshaft sprocket portion 58 and a camshaft ring gear portion 60 one of which is eccentric to the other. The camshaft sprocket portion 58 and the camshaft ring gear portion 60 may not be separated by a shoulder having an outer diameter larger than either the camshaft sprocket portion 58 or the camshaft ring gear portion 60 that would separate the phaser bearings. Instead, the camshaft sprocket portion 58 and the camshaft ring gear portion 60 may each be sized to permit the phaser bearings to both slide over the eccentric shaft 44 from one end and, in some implementations, abut each other when the camshaft phaser 10 is assembled. Put differently, the sprocket bearing 16 and a camshaft bearing 62 can both be inserted into the sprocket 12 and the eccentric shaft 44 can then be inserted into the inner diameters of both bearings at the same time from one side of the camshaft phaser 10.

The camshaft sprocket portion 58 can be substantially annular having an outside surface that closely conforms to an inner diameter of the sprocket bearing 16. The camshaft ring gear portion 60 can be eccentric relative to the camshaft sprocket portion 58. An outer surface of the camshaft ring gear portion 60 may be smaller in diameter relative to the camshaft bearing 62 and includes a recess 64 (shown in FIG. 5) for receiving a planetary biasing member 66. The camshaft bearing 62 can have a larger inner and outer diameter than the sprocket bearing 16. The increased diameter size of the camshaft bearing 62 can permit insertion of the eccentric shaft 44 even after the sprocket bearing 16 has been inserted into the bearing opening 32 and the sprocket bearing 16 has been placed into the sprocket 12. The planetary biasing member 66 can help forcibly engage the compound planetary gear 42 with the sprocket ring gear 14 and the camshaft ring gear 22. One end of the planetary biasing member 66 can engage the eccentric shaft 44 at the recess 64 and another end of the planetary biasing member 66 can direct force radially outwardly and toward an internal surface 68 of the camshaft bearing 62. The recess 64 is located on the outer surface of the camshaft ring gear portion 60 and includes a reduced diameter section that can prevent movement of the planetary biasing member 66.

The compound planetary gear 42 includes a sprocket planetary gear 70 and a camshaft planetary gear 72. The sprocket planetary gear 70 and the camshaft planetary gear 72 include a set of outwardly-facing sprocket planetary gear teeth 74 that engage with the sprocket ring gear 14 and a set of outwardly-facing camshaft planetary gear teeth 76 that engage with the camshaft ring gear 22, respectively. The number of gear teeth 74 used by the sprocket planetary gear 70 is different than the number of gear teeth 18 used by the sprocket ring gear 14 by more than one. And the camshaft ring gear 22 includes one or more additional gear teeth 24 relative to the number of gear teeth 76 on the camshaft planetary gear 72. In one implementation, the number of gear teeth differ by two.

The compound planetary gear 42 in this implementation includes three planetary fluid escapement channels. The three planetary fluid escapement channels will be described as a first planetary fluid escapement channel, a second planetary fluid escapement channel, and a third planetary fluid escapement channel. However, it should be appreciated that any one of these fluid escapement channels can be implemented alone without the others. For example, a phaser could implement the compound planetary gear 42 using the second planetary fluid escapement channel without also including the first and third planetary fluid escapement channels. A first planetary fluid escapement channel 80 has a first edge 82 that is adjacent a face of the gear teeth of the sprocket planetary gear 70 and a second edge 84 that is radially-inward from the first edge 82. A second planetary fluid escapement channel 88 can be positioned axially in between the sprocket planetary gear 70 and the camshaft planetary gear 72. The second planetary fluid escapement channel 88 can include a first edge 90 and a second edge 92. The first edge 90 can abut a root circle 102 of the camshaft planetary gear 72 and the second edge 92 can be radially spaced apart from the second edge 90 and be formed adjacent to or coincidental with the root circle 102 of the camshaft planetary gear 72. The third planetary fluid escapement channel 100 can be axially adjacent the camshaft planetary gear 72 and extend radially outwardly from the root circle 102 of the camshaft planetary gear 72. Rather than having a second edge, the third planetary fluid escapement channel 100 can be formed by reducing the width of the gear teeth 76 of the camshaft planetary gear 72 along the axis of camshaft rotation (x). The third planetary fluid escapement channel 100 can be a space created between the axial end 104 of the compound planetary gear 42 and the faces 106 of the gear teeth 76 of the camshaft planetary gear 72.

The camshaft plate 20 is configured to be attached to the camshaft and includes the camshaft ring gear 22. A camshaft plate end 110 substantially closes one end of the camshaft plate 20 and includes a bolt aperture 112 through which a retention bolt 114 passes and couples the camshaft to the camshaft plate 20. While in this embodiment a single retention bolt 114 is shown, other implementations could use a plurality of retention bolts. In addition, the camshaft plate 20 includes an outer surface 116 that abuts a radially inwardly-facing surface 118 of the sprocket 12 so that the outer surface 116 of the camshaft plate 20 is radially-inward from the radially inwardly-facing surface 118 of the sprocket 12. A camshaft fluid escapement channel 108 can be formed in an axially inwardly facing surface 120 of the camshaft plate 20. The camshaft fluid escapement channel 108 can extend from a first edge 122 to a second edge 124 that is radially inward from the first edge 122. The camshaft fluid escapement channel 108 can have a depth that extends below the axially inwardly facing surface 120 of the camshaft plate 20.

It is to be understood that the foregoing is a description of one or more embodiments of the invention. The invention is not limited to the particular embodiment(s) disclosed herein, but rather is defined solely by the claims below. For example, the camshaft phaser described herein uses an eccentric shaft and a compound planetary gear. However, it should be appreciated that the fluid escapement channels could also be used with other camshaft phaser designs. It is also possible to include fluid escapement channels with other planetary gearboxes, such as those using a sun gear and a plurality of planetary gears. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An electrically-actuated camshaft phaser used in an internal combustion engine (ICE), the electrically-actuated camshaft phaser comprising:

a camshaft sprocket configured to receive rotational input from a crankshaft, the camshaft sprocket including a sprocket ring gear having a plurality of radially-inwardly facing gear teeth and a radially extending sprocket side;

a camshaft plate including a camshaft ring gear having a plurality of radially-inwardly facing gear teeth and a radially extending camshaft side;

a plurality of planetary gears having radially-outwardly facing gear teeth, each planetary gear including a first axial end face and a second axial end face, wherein the plurality of planetary gears engages at least one of the sprocket ring gear or the camshaft ring gear; and one or more fluid escapement channels formed as annular grooves in at least one of the first axial end faces and/or at least one of the second axial end faces.

2. The electrically-actuated camshaft phaser recited in claim 1, further comprising a camshaft sprocket fluid escapement channel formed as an annular groove in an axially inwardly-facing surface of the radially extending sprocket side.

3. The electrically-actuated camshaft phaser recited in claim 1, wherein the one or more fluid escapement channels includes a first planetary fluid escapement channel abutting the radially extending sprocket side.

4. The electrically-actuated camshaft phaser recited in claim 1, wherein the one or more fluid escapement channels includes a second planetary fluid escapement channel positioned between adjacent planetary gears of the plurality of planetary gears.

5. The electrically-actuated camshaft phaser recited in claim 1, wherein the one or more fluid escapement channels includes a third planetary fluid escapement channel abutting the radially extending camshaft side.

6. The electrically-actuated camshaft phaser recited in claim 1, further comprising a camshaft fluid escapement channel formed as an annular groove in an axially inwardly-facing surface of the radially extending camshaft side.

7. An electrically-actuated camshaft phaser used in an internal combustion engine (ICE), the electrically-actuated camshaft phaser comprising:

a camshaft sprocket configured to receive rotational input from a crankshaft, the camshaft sprocket including a sprocket ring gear having a plurality of radially-inwardly facing gear teeth and a radially extending sprocket side;

a camshaft plate including a camshaft ring gear having a plurality of radially-inwardly facing gear teeth and a radially extending camshaft side;

a compound planetary gear including:

a first axial end face, a second axial end face, a camshaft planetary gear configured to engage the camshaft ring gear via radially-outwardly facing gear teeth, and a sprocket planetary gear configured to engage the sprocket ring gear via radially-outwardly facing gear teeth; and one or more fluid escapement channels formed as annular grooves in at least one of the first axial end face or the second axial end face.

8. The electrically-actuated camshaft phaser recited in claim 7, further comprising a camshaft sprocket fluid escapement channel formed as an annular groove in an axially inwardly-facing surface of the radially extending sprocket side.

9. The electrically-actuated camshaft phaser recited in claim 7, wherein the one or more fluid escapement channels includes a first planetary fluid escapement channel abutting the radially extending sprocket side.

10. The electrically-actuated camshaft phaser recited in claim 7, further comprising a second planetary fluid escapement channel formed as an annular groove in an axially facing surface of the compound planetary gear between the sprocket planetary gear and the camshaft planetary gear.

11. The electrically-actuated camshaft phaser recited in claim 7, wherein the one or more fluid escapement channels includes a third planetary fluid escapement channel abutting the radially extending camshaft side.

12. The electrically-actuated camshaft phaser recited in claim 7, further comprising a camshaft fluid escapement channel formed as an annular groove in an axially inwardly-facing surface of the radially extending camshaft side.

13. An electrically-actuated camshaft phaser used in an internal combustion engine (ICE), the electrically-actuated camshaft phaser comprising:

a camshaft sprocket configured to receive rotational input from a crankshaft, the camshaft sprocket including a sprocket ring gear having a plurality of radially-inwardly facing gear teeth and a radially extending sprocket side;

a camshaft plate including a camshaft ring gear having a plurality of radially-inwardly facing gear teeth and a radially extending camshaft side;

a planetary gear having radially-outwardly facing gear teeth engaging the camshaft ring gear and the sprocket planetary gear; and one or more fluid escapement channels formed as annular grooves in at least one axial end face of the planetary gear.

14. The electrically-actuated camshaft phaser recited in claim 13, further comprising a camshaft sprocket fluid escapement channel formed as an annular groove in an axially inwardly-facing surface of the radially extending sprocket side.

15. The electrically-actuated camshaft phaser recited in claim 13, further comprising a camshaft fluid escapement channel formed as an annular groove in an axially inwardly-facing surface of the radially extending camshaft side.

* * * * *